United States Patent [19]

Senoh

[11] 4,258,923

[45] Mar. 31, 1981

[54] FOOTBALL GOAL STRUCTURE

[76] Inventor: Fushi Senoh, 2-31-13, Shinmachi, Setagaya-ku, Tokyo, Japan

[21] Appl. No.: 36,419

[22] Filed: May 7, 1979

[51] Int. Cl.[3] ..... A63B 71/00

[52] U.S. Cl. ..... 273/398

[58] Field of Search ..... 273/55 B, 26 A, 127 B, 273/127 R, 127 C, 1 B, 401, 402, 411, 398; 272/101, 102, 103

[56] References Cited

U.S. PATENT DOCUMENTS

| | | | |
|---|---|---|---|
| 2,583,786 | 1/1952 | Manzucco | 272/103 |
| 3,979,120 | 9/1976 | Dielrich | 273/127 B |
| 4,068,846 | 1/1978 | Forrest | 273/55 B |
| 4,083,561 | 4/1978 | Daffer, Jr. | 273/127 C |

*Primary Examiner*—Richard C. Pinkham
*Assistant Examiner*—T. Brown
*Attorney, Agent, or Firm*—Pearne, Gordon, Sessions, McCoy & Granger

[57] ABSTRACT

A football goal structure which comprises a framework including a number of tubular frame members connected together through elbows interposed between the adjacent tubular frame members, a net secured to the framework and flanged weight means fitted within selected ones of the tubular frame members so as to improve the stability of the goal structure.

6 Claims, 2 Drawing Figures

FOOTBALL GOAL STRUCTURE

BACKGROUND OF THE INVENTION

This invention relates to an association football goal structure for children which comprises a framework consisting of a number of synthetic resin tubular frame members detachably connected together by means of elbows and which has weight means provided at the bottom of the framework to improve the stability of the goal structure whereby the goal structure can maintain its stabilized state and is inhibited from inadvertently moving when subjected to the shock by a ball striking against the goal structure during an association football play.

There have been proposed and practically employed a variety of association football goal structures for children and most of the conventional goal structures for such a purpose have rigid frameworks consisting of steel pipes or wood pieces. However, the conventional goal structures having such rigid frameworks are inconvenient to assemble and disassemble and require a relatively large space for storage. Also, the conventional association football structures are expensive and unsuitable for children.

SUMMARY OF THE INVENTION

Therefore, one object of the present invention is to provide an association football goal structure for children which can effectively eliminate the disadvantages inherent in the conventional association football structures.

Another object of the present invention is to provide an association football goal structure which can be conveniently assembled and disassembled.

Another object of the present invention is to provide an association football goal structure which is light in weight and convenient for carrying about.

Another object of the present invention is to provide an association football goal structure which comprises a framework consisting of synthetic resin (vinyl chloride, for example) tubular frame members detachably connected together by means of synthetic resin elbows and has metal weights provided in the bottom tubular frame members whereby the goal structure can maintain its stabilized state and is inhibited from inadvertently moving when subjected to the shock by a ball striking against the goal structure during a football play.

According to the present invention, there has been provided an association football goal structure which comprises a synthetic resin framework including a pair of spaced and parallel upright tubular frame members, a horizontal upper front tubular frame member connected at the opposite ends thereof to the upper ends of said upright tubular frame members, a pair of shorter bottom tubular frame members each connected at one end thereof to the lower ends of said upright tubular frame members and a rear bottom frame member connected at the opposite ends to the other ends of said shorter bottom tubular frame members; a net stretched across and secured to said framework; and flanged weight means fitted within one of the adjacent ends of the associated upright tubular frame member and shorter bottom tubular frame member and one of the adjacent ends of the associated shorter bottom tubular member and rear bottom tubular frame member, respectively, said flanged weight means having a diameter substantially corresponding to the inner diameter of the tubular frame member in which the weight means is fitted and the diameter of the flange substantially corresponding to the outer diameter of the associated tubular frame member.

The above and other objects and attendant advantages of the present invention will be more readily apparent to those skilled in the art from a reading of the following detailed description in conjunction with the accompanying drawing in which one preferred embodiment of the invention is shown for illustration purpose only, but not for limiting the scope of the invention in any way.

PREFERRED EMBODIMENT OF THE INVENTION

Figure 1:
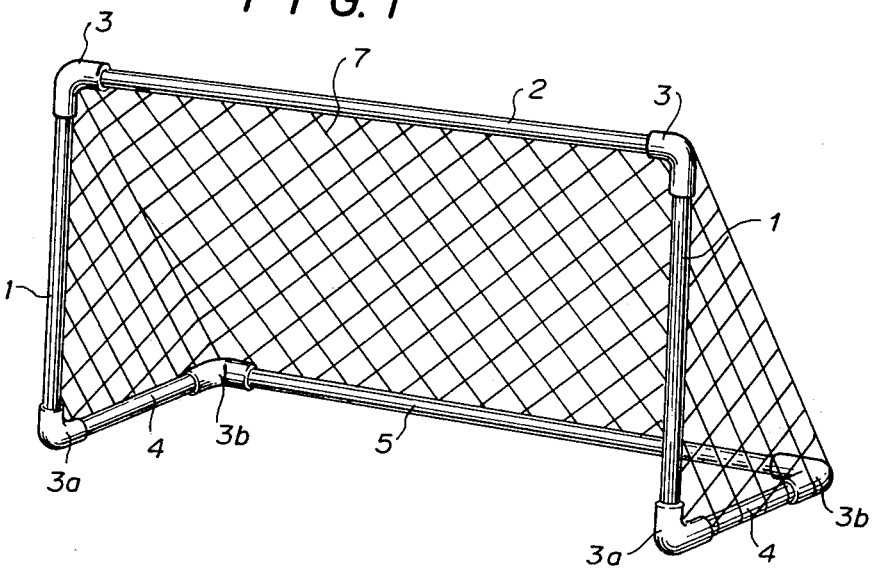
FIG. 1 is a perspective view of one embodiment of a football goal structure according to the present invention.

The present invention will be now described referring to the accompanying drawing in which one preferred embodiment of synthetic resin association football goal structure constructed in accordance with the present invention is shown for illustration purpose only, but not for limiting the scope of the same in any way. In FIG. 1, reference numeral 1 denotes a pair of left-hand side and right-hand side upright tubular frame members and the pillars or upright tubular frame members are arranged in spaced and parallel relationship. The upright tubular frame members 1, 1 are connected at the upper ends to the opposite ends of a horizontal upper front tubular frame member 2 by means of elbows 3, 3. A pair of left-hand side and right-hand side shorter tubular bottom frame members 4, 4 are connected at one or the front ends to the lower ends of the left-hand side and right-hand side upright tubular frame members 1, 1 by means of elbows *3a, 3a,* respectively, and extend rearwardly of the upright tubular frame members. A horizontal tubular rear bottom frame member 5 is connected at the opposite ends to the other or rear ends of the shorter tubular bottom frame members 4, 4 by means of elbows *3b, 3b.* The horizontal rear bottom tubular frame member 5 is parallel to the horizontal upper front tubular frame member 2, but extends in a horizontal plane lower than and rearwardly offset from that in which the horizontal upper tubular frame member does.

Figure 2:
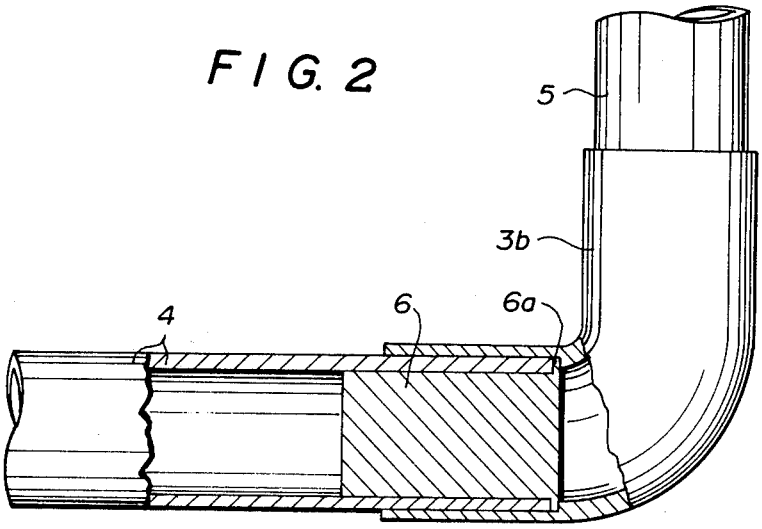
FIG. 2 is a fragmentary plan view on an enlarged scale in partial section of a portion of the framework of the football goal structure as shown in FIG. 1.

The tubular frame members 1, 2, 4 and 5 and elbows 3 are formed of vinyl chloride and form the framework of the association football goal structure of the present invention. A steel weight 6 is fitted within one of the adjacent ends of the associated upright tubular frame member 1 and shorter tubular bottom frame member 4 and a similar steel weight is also fitted within one of the adjacent ends of the associated shorter tubular bottom frame member 4 and horizontal tubular rear bottom member 5 to thereby improve the stability of the football goal structure. In FIG. 2, one of the weights 6 is shown as being fitted within the end of the right-hand side shorter tubular bottom frame member 4 (as seen in FIG. 2) where the shorter tubular bottom frame member is connected to the horizontal rear bottom tubular frame member 5. The weight 6 has a diameter substantially corresponding to the inner diameter of the tubular frame member in which the weight is fitted and a flange 6*a* at one end thereof. The flange 6*a* has a diameter substantially corresponding to the outer diameter of the associated tubular member and is adapted to abut against the end face of the tubular frame member in which the weight is fitted. Before the tubular frame members are connected together by means of the elbows, a suitable adhesive is applied to the inner surfaces of the elbows. After the framework of the football goal structure of the invention has been formed by connecting the tubular frame members together, a net 7 is stretched across and secured to the framework to thereby complete the association football goal structure.

As clear from the foregoing description of the preferred embodiment of the present invention, since the framework is formed of the vinyl chloride tubular frame members and elbows, the goal structure is light in weight and convenient for carrying about. And since the tubular frame members are adapted to be connected together by means of the elbows, the frame members can be easily and promptly assembled and disassembled. Thus, the goal structure can be conveniently transported and stored and is less expensive.

And since the weights 6 are fitted in the junctions between the upright tubular frame members 1 and shorter bottom tubular frame members 4 and between the shorter bottom tubular frame members 4 and rear bottom tubular frame member 5, respectively, even when the goal structure is placed on a concrete road which presents a slippery surface, the goal structure can stand in a stabilized state against the shock of a ball striking against the goal structure during an association football play. Also since the weights 6 are fitted within the tubular frame members and not exposed to the outside of the tubular frame members, the weights do not impair the external appearance of the goal structure.

Although the best mode contemplated for carrying out the present invention has been herein shown and described, it will be apparent that modification and variation may be made without departing from what is regarded to be the subject matter of the invention.

What is claimed is:

1. A football goal structure with weight means, comprising a synthetic resin framework including a pair of spaced and parallel upright tubular frame members, a horizontal upper front tubular frame member connected at the opposite ends to the upper ends of said upright tubular frame members, a pair of shorter bottom tubular frame members connected each at one ends to the lower ends of said upright tubular frame members and extending rearwardly of the upright tubular frame members, and a rear bottom tubular frame member connected at the opposite ends to the other ends of said shorter bottom tubular frame members; a net stretched across and secured to said framework; and flanged weight means fitted within one of the adjacent ends of one of said upright tubular frame members and associated shorter bottom tubular frame member and one of the adjacent ends of one of said shorter bottom tubular members and associated rear bottom tubular frame member, respectively, said flanged weight means having the diameter substantially corresponding to the inner diameter of the tubular frame member in which the weight means is fitted and the diameter of the flange substantially corresponding to the outer diameter of the associated tubular frame member.

2. The football goal structure as set forth in claim 1, in which said tubular frame members are connected together by means of elbows.

3. The football goal structure as set forth in claim 2, wherein said weight means is telescoped inside an end of one of said frame members and also telescoped inside an end of one of said elbows to be concealed and to strengthen the connection.

4. The football goal structure as set forth in claim 2, wherein said flange of said weight means is disposed axially between an end of one of said frame members and a shoulder in one of said elbows.

5. The football goal structure as set forth in claim 1, in which said flange of the weight means abuts against the end face of the associated tubular frame member in which the weight means is fitted.

6. The football goal structure as set forth in claim 1, in which said rear bottom tubular frame member is parallel to said front tubular frame member, but extends in a horizontal plane lower than and rearwardly offset from a horizontal plane in which the front tubular frame member extends.

* * * * *

UNITED STATES PATENT AND TRADEMARK OFFICE

CERTIFICATE OF CORRECTION

PATENT NO. : 4,258,923

DATED : March 31, 1981

INVENTOR(S) : Fushi Senoh

It is certified that error appears in the above-identified patent and that said Letters Patent are hereby corrected as shown below:

Column 1, line 59, after "ends" (first occurrence) insert --thereof--
Claim 1, column 4, line 3, delete "ends" (first occurrence)
Claim 1, column 4, line 3, after "opposite" insert --end thereof--
Claim 1, column 4, line 5, delete "ends" and insert --end thereof--.
Claim 1, column 4, line 9, after "ends" insert --thereof--.
Claim 1, column 4, line 17, after "means" insert --being completely concealed within said framework and--
Claim 1, column 4, line 17, delete "the" and insert --a--.

Signed and Sealed this

Eleventh Day of August 1981

[SEAL]

Attest:

GERALD J. MOSSINGHOFF

Attesting Officer

Commissioner of Patents and Trademarks